US006494386B1

(12) United States Patent
Banu

(10) Patent No.: US 6,494,386 B1
(45) Date of Patent: Dec. 17, 2002

(54) SPRINKLER HEAD HOUSING

(75) Inventor: John I. Banu, Fort Lauderdale, FL (US)

(73) Assignee: Ocean Test Equipment. Inc., Ft. Lauderdale, FL (US)

( * ) Notice: Subject to any disclaimer, the term of this patent is extended or adjusted under 35 U.S.C. 154(b) by 0 days.

(21) Appl. No.: 09/711,242

(22) Filed: Nov. 9, 2000

(51) Int. Cl.[7] ..... B05B 15/06

(52) U.S. Cl. ..... 239/288; 239/200; 239/203; 239/204; 239/205; 239/206; 239/207; 239/288.3; 239/288.5

(58) Field of Search ..... 239/200, 201, 239/202, 203, 204, 205, 206, 207, 288, 288.3, 288.5

(56) References Cited

U.S. PATENT DOCUMENTS 4,212,426 A 7/1980 Choi
4,220,283 A * 9/1980 Citron ..... 239/205
4,783,004 A * 11/1988 Lockwood ..... 239/205
5,023,989 A 6/1991 Hargrave
5,137,307 A * 8/1992 Kinsey ..... 239/201 X
5,222,669 A 6/1993 Lawson
5,253,952 A * 10/1993 Selway ..... 239/201 X
5,938,121 A 8/1999 Ferguson et al.

* cited by examiner

*Primary Examiner*—Robin O. Evans
(74) *Attorney, Agent, or Firm*—Laurence A. Greenberg; Werner H. Stemer; Gregory L. Mayback

(57) ABSTRACT

A sprinkler head housing encloses, supports, and provides access to a sprinkler head in order to allow maintenance and access to the sprinkler head. The sprinkler head housing includes a top and a wall descending therefrom. The sprinkler head housing can accommodate sprinkler heads having differently sized diameters.

14 Claims, 2 Drawing Sheets

SPRINKLER HEAD HOUSING

BACKGROUND OF THE INVENTION

1. Field of the Invention

The invention relates to sprinkler head housings that hold, support, and provide easy access to pop-up sprinkler heads.

2. Description of the Related Art

Pop-up sprinkler systems are well known and used for watering lawns. Most sprinkler heads are made by one of several manufacturers. Each manufacturer produces a sprinkler head having its own size, measured by the diameter of its top. Typically, these pop-up sprinkler systems include a plastic sprinkler head having a body, a connector on the bottom of the body that attaches to a water supply hose, and a nozzle through which the water sprays. The entire sprinkler head is buried in the ground so that their tops are flush with the surface of the ground. When water is pumped to the sprinkler head, a nozzle in the sprinkler head pops up and sprinkles water.

Due to their location on the surface of the ground, sprinkler heads are exposed to physical stresses such as people stepping on them and lawnmowers accidentally cutting them and rolling over them. In addition, by buring the sprinkler head in the ground, the sprinkler head is not able to flex downward and give under any pressure from the surface. As a result of these stresses, sprinkler heads are often damaged and require maintenance and replacement.

Another problem with sprinkler heads is that the connection between the sprinkler head and its hose often loosens and deteriorates with time. As a result, the connection needs to be maintained or replaced.

Another problem with sprinkler heads are that the nozzle become clogged with dirt and accumulated minerals. Mineral build-up especially problematic in sprinklers because untreated, hard well water is often used with sprinklers to save expense over treated water. If the sprinkler head is buried, the entire head often must be undug to repair the nozzle.

Traditionally, to maintain or replace a sprinkler head, the dirt surrounding the sprinkler head must be removed, then the sprinkler head can be repaired and then the dirt must be replaced. The process of digging requires extra tools like a spade and can leave unsoded dirt spots around each sprinkler head.

SUMMARY OF THE INVENTION

An object of the invention is to provide a sprinkler head housing which overcomes the above-mentioned disadvantages of the heretofore-known devices and methods of this general type.

With the foregoing and other objects in view there is provided, in accordance with the invention, a sprinkler head housing including a top having an inner support abutting a sprinkler head, and a wall descending from the top. The wall should be at least as tall as the sprinkler head.

In accordance with another feature of the invention, the top can be circular and can include a rim and the wall fits under the rim. By using such a construction, the wall can be made from a flexible sheet wrapped upon itself. To maintain the shape of the flexible sheet even when the top is removed the sprinkler head housing can include straps surrounding the wall. Another way to maintain the shape of the wall made from the flexible sheet is to form two holes in the wall and then connect the two holes with a wire. A construction made from a flexible sheet wrapped into a wall, has the advantage of reduced cost to manufacture. In addition, the space required during shipping is minimized by including a housing made from a flat sheet as opposed to an assembled housing.

The wall should be at least as tall as the sprinkler head. By having such a height, the sprinkler head housing provides large enough space to guarantee full access to the sprinkler head, especially the bottom of the sprinkler head where the hose connects to the sprinkler head.

In accordance with another feature of the invention, the wall of the sprinkler head housing has an outlet formed in it. The outlet allows for tubing feeding water to the sprinkler head to enter the sprinkler head housing. This is especially useful when the sprinkler head housing has an elbow joint at its bottom to allow it to connect to a horizontal hose.

In accordance with another feature of the invention, the inner support includes a bracket abutting the sprinkler head that allows the sprinkler head housing to accommodate different brands of sprinkler heads having different diameters. While the invention encompasses sprinkler head housings that accommodate only one size of sprinkler head, it is preferable to form a sprinkler head housing that can accommodate different sizes of sprinkler head. According to the invention, the inner support can include a plurality of brackets. These brackets have different widths so as to support different sprinkler heads having different, complementary diameters. The different lengths hold and support different diameters of sprinkler heads. If the sprinkler head is too large to fit in the sprinkler head housing with all of the brackets, the brackets are removed from longest to shortest until the sprinkler head does fit snugly against the brackets of the inner support. To form a removable bracket, the bracket can be made from thin plastic that is snapped off and removed from the inner surface.

To support a sprinkler head evenly from all sides a first plurality of brackets having a length corresponding to a first sized sprinkler head can be distributed evenly about the inner surface of the top. Likewise, a second plurality of brackets having a second length corresponding to a second sized sprinkler head can be distributed evenly about the inner surface of the top. In the same, any number of brackets can be added so that the sprinkler head housing can accommodate that number of differently sized sprinkler heads.

Other features that are considered as characteristic for the invention are set forth in the appended claims.

An object of the invention is to allow access for maintenance and replacement of the sprinkler head without requiring digging.

A further object of the invention is to hold and support the sprinkler head in a vertical position that is flush with the surface of the ground.

A further object of the invention is to provide a sprinkler head housing that can accommodate various sized sprinkler heads, particularly the standard sizes made by manufacturers of sprinkler heads.

Although the invention is illustrated and described herein as embodied in a sprinkler head housing, it is nevertheless not intended to be limited to the details shown, because various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
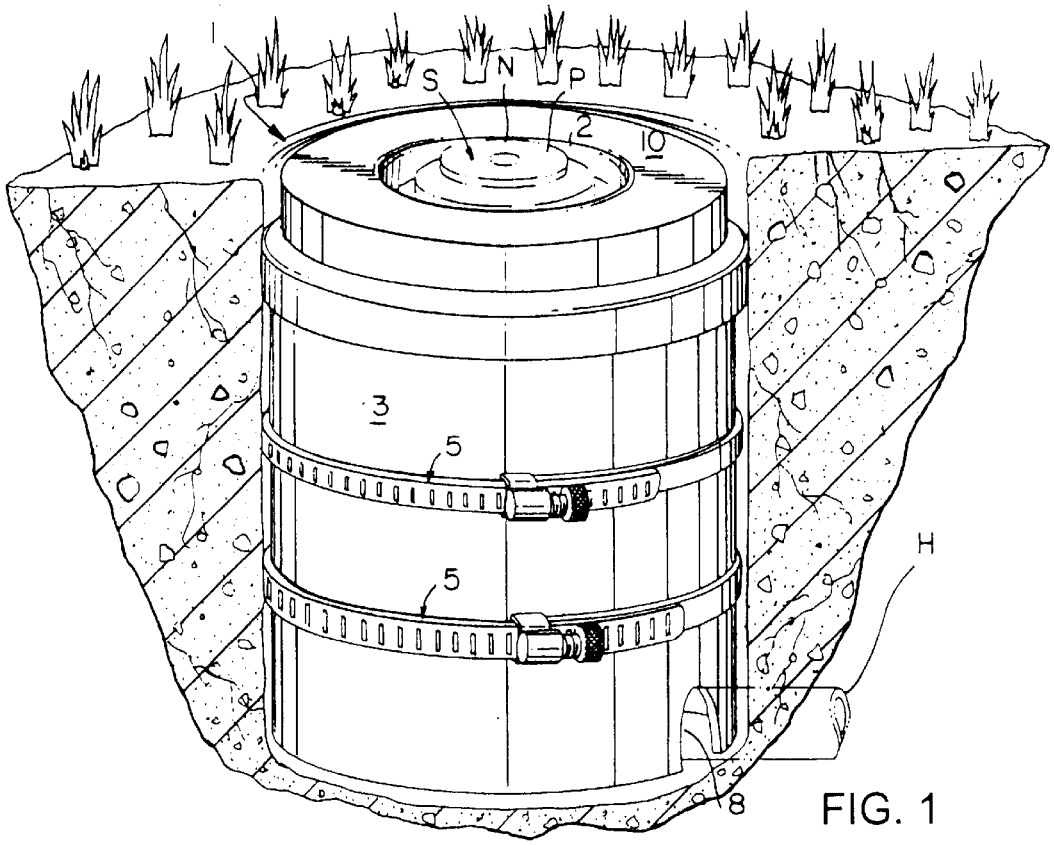
FIG. 1 is a perspective view of a sprinkler head housing buried in the ground.

Referring now to the figures of the drawing in detail and first, particularly, to FIG. 1 thereof, there is seen a sprinkler head housing generally marked with the reference number 1. The sprinkler head housing 1 protects and supports a sprinkler head S in a secure and vertical position.

Figure 2:
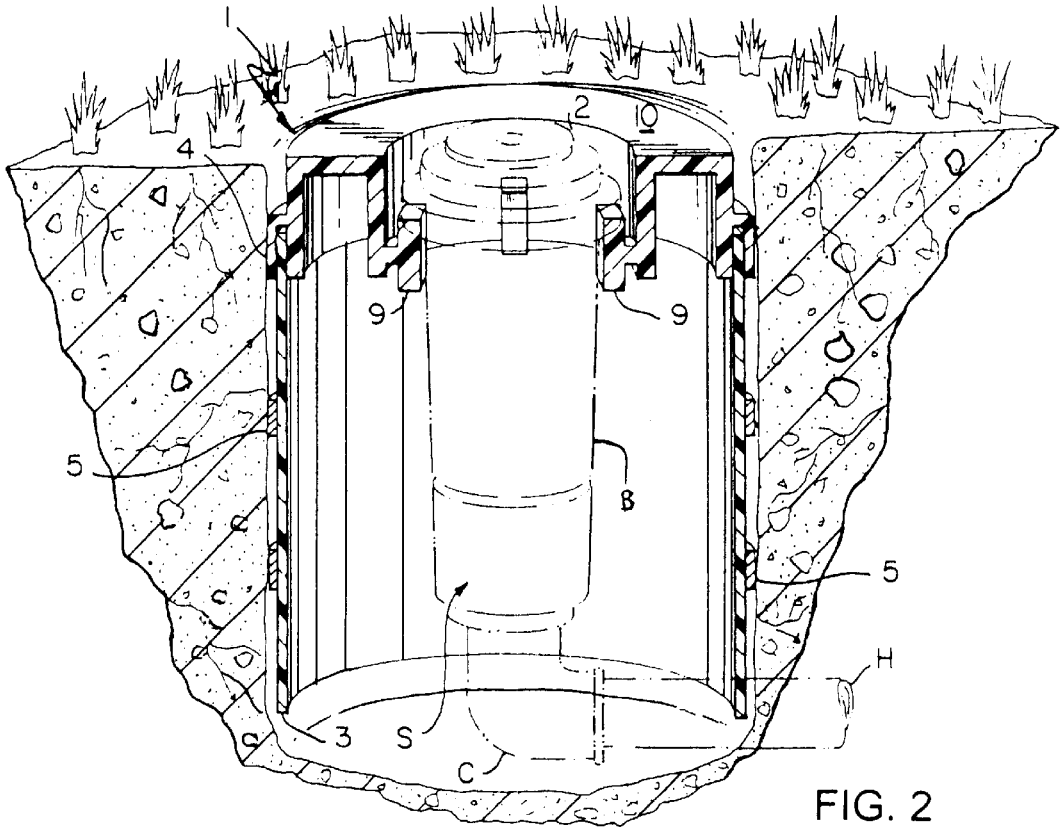
FIG. 2 is a cross section view of the sprinkler head housing taken along the line 2 shown in FIG. 1.

FIG. 2 shows a sprinkler head S in a sprinkler head housing 1. The sprinkler head S is typical of the pop-up type. The sprinkler head S includes a body B. A nozzle N having a piston P is connected to the top of the body B. A connector C is at the bottom of the body B. The connector C connects to a water supply hose H.

The sprinkler head housing 1 includes a top 10. The top 10 includes an inner support 2. Preferably, the inner support 2 is an inner edge. The inner support 2 holds and supports the sprinkler head S. The top of the sprinkler head S is placed flush with the top 10.

As seen in FIG. 2, the top includes a downward-facing rim 4 about the perimeter of the top. A wall 3 tucks into the rim 4 and descends downward from the top 10. The wall 3 is at least as tall as the sprinkler head S. The wall 3 defines a cavity that holds the sprinkler head S. The wall 3 is preferably constructed from a flexible rectangular sheet of material that is folded upon itself to form a cylinder. The wall formed from a flexible sheet can be held in place by straps 5. The straps 5 have a circumference equal to that of the top 10 and thereby hold the wall 3 to a size complementing the top 10.

Figure 4:
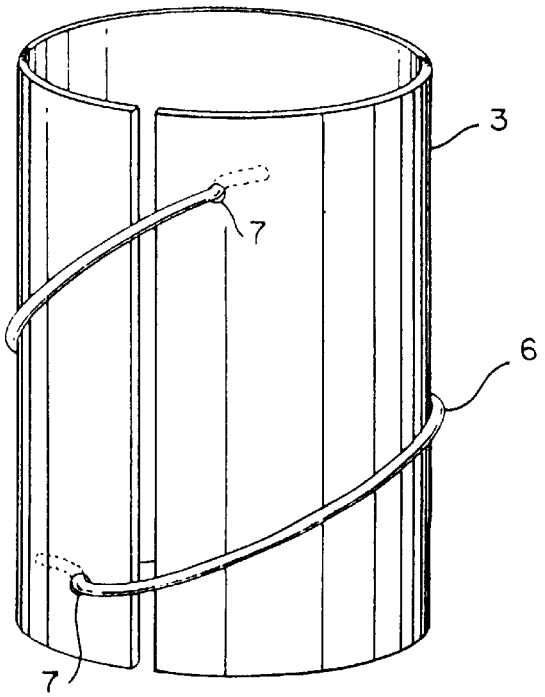
FIG. 4 is a perspective view of a bent sheet wrapped with wire to form a wall.

FIG. 4 shows an alternative form of construction. In this embodiment, a sheet bent upon itself into a cylinder forms the wall 3. The wall 3 contains two holes 7. A wire 6 inserts into the two holes 7 and holds the sheet in a cylindrical position. The wire 6 has two bent ends that prevent the wire 6 from pulling through the holes 7.

The wall 3 has an outlet 8 formed therein. The outlet 8 provides a location where a water pipe (not shown) feeding the sprinkler head S can enter the sprinkler head housing 1.

Figure 3:
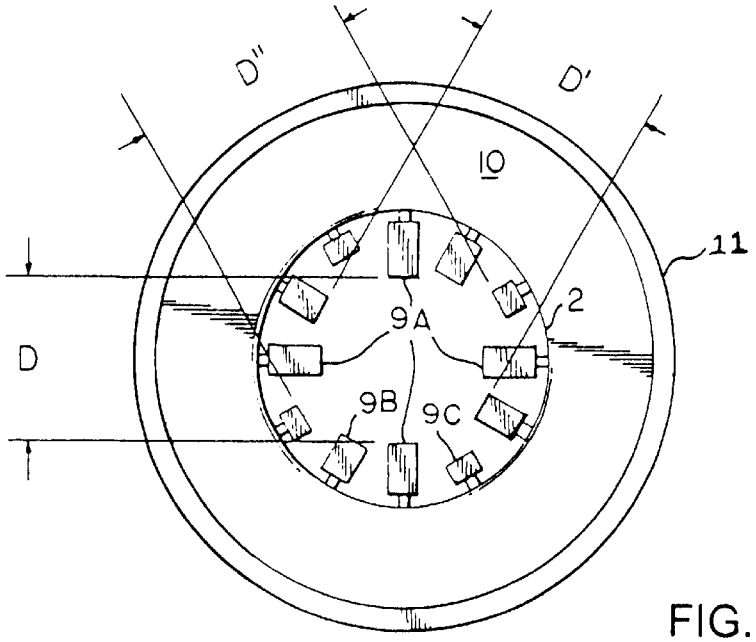
FIG. 3 is a plan view of the sprinkler head housing.

FIG. 3 shows a plan view of the top 10 defining a perimeter 11. The inner support 2 includes a plurality of brackets 9. The brackets 9 form part of the inner support 2. The brackets 9 hold and support the sprinkler head S in a vertical position. The brackets 9 have different lengths. Brackets 9*a* all have one size and are designed to complement a sprinkler head having a first diameter D. Brackets 9*b* all have a second size and are designed to complement a sprinkler head having a second diameter D'. Brackets 9*c* all have a third size and are all designed to complement a sprinkler head S having a third diameter ". While only three sets of brackets 9*a*, 9*b*, and 9*c* are shown, other quantities of sets of brackets can be included. The brackets 9 are evenly spread about the inner support 2 to hold and support the sprinkler head S from all sides. The brackets 9*a*, 9*b*, and 9*c* are removable. By being removable, only the brackets complementing the sprinkler head S being used remain in place. For example, if a sprinkler head having a diameter D" is used, brackets 9*a* and 9*b* can be removed. A most preferred way of forming removable brackets 9*a*, 9*b*, and 9*c* from brittle plastic so that the brackets 9*a*, 9*b*, and 9*c* can be snapped off.

FIG. 1 shows how the sprinkler head housing is used 1. First, a hole larger than the sprinkler head housing 1 is dug in the ground around the sprinkler head S. The sprinkler head housing 1 is lowered into the hole and the sprinkler head is supported by the inner support 2. Dirt is filled under the sprinkler head housing 1 so that the top 10 is flush with the surface of the ground. Then, the hole is filled outside of the wall 3.

Once installed, the sprinkler head housing 1 allows easy access to the sprinkler head S by removing the top 10. If necessary, the sprinkler head S even can be replaced without removing the sprinkler head housing 1. The cavity created by the wall 3 allows access to the sprinkler head S. The wall 3 prevents the dirt from caving in the hole. Also by maintaining a cavity, the connection between the sprinkler head S and hose can be evaluated without undigging the sprinkler head. When maintenance is completed, the top 10 is replaced on the wall 3 to hold and support the sprinkler head S.

I claim:

1. A sprinkler head housing for supporting, protecting, and providing access to a sprinkler head having a body, and a nozzle and connector connected to the body; the sprinkler head housing comprising:

a top having an inner support abutting the sprinkler head; and a wall descending from said top;

said support including a plurality of first brackets spaced evenly about said support, said first brackets supporting a first sprinkler head in a vertical position, the first sprinkler head having a first diameter.

2. The sprinkler head housing according to claim 1, wherein said wall is at least as tall as the sprinkler head.

3. The sprinkler head housing according to claim 1, wherein said top is circular.

4. The sprinkler head housing according to claim 1, wherein said top has a rim.

5. The sprinkler head housing according to claim 4, wherein said wall fits under said rim.

6. The sprinkler head housing according to claim 1, wherein said top defines a perimeter and said wall descends from said perimeter.

7. The sprinkler head housing according to claim 5, further comprising:

a strap surrounding said wall.

8. The sprinkler head housing according to claim 7, further comprising:

a second strap surrounding said wall.

9. The sprinkler head housing according to claim 5, further comprising:

a wire threaded through two holes formed in said wall.

10. The sprinkler head housing according to claim 1, wherein said wall forms an outlet.

11. The sprinkler head housing according to claim 1, wherein said support includes a bracket abutting the sprinkler head.

12. The sprinkler head housing according to claim 11, wherein said bracket is removable.

13. The sprinkler head housing for supporting, protecting, and providing access to a sprinkler head having a body, and a nozzle and connector connected to the body; the sprinkler head housing comprising:

a top having an inner support abutting the sprinkler head; and a wall descending from said top;

said support including a first bracket for holding a sprinkler head having a first diameter and a second bracket for holding a sprinkler head having a second diameter, wherein said first diameter and said second diameter are different.

14. A sprinkler head housing for supporting, protecting, and providing access to a sprinkler head having a body, and a nozzle and connector connected to the body; the sprinkler head housing comprising:

a top having an inner support abutting the sprinkler head; and a wall descending from said top;

said support including a first plurality of first brackets spaced evenly about said support, wherein said first brackets support a first sprinkler head having a first diameter, and said support includes a second plurality of second brackets spaced evenly about said support, wherein said second brackets support a second sprinkler head having a second diameter that is different than the first diameter.

* * * * *